US008390407B2

(12) United States Patent
Diem et al.

(10) Patent No.: US 8,390,407 B2
(45) Date of Patent: Mar. 5, 2013

(54) ELECTROMECHANICAL ACTUATOR WITH INTERDIGITATED ELECTRODES

(75) Inventors: Bernard Diem, Echirolles (FR); Henri Sibuet, La Buisse (FR)

(73) Assignee: Commissariat a l'Energie Atomique, Paris (FR)

( * ) Notice: Subject to any disclaimer, the term of this patent is extended or adjusted under 35 U.S.C. 154(b) by 172 days.

(21) Appl. No.: 12/879,261

(22) Filed: Sep. 10, 2010

(65) Prior Publication Data

US 2011/0220470 A1 Sep. 15, 2011

(30) Foreign Application Priority Data

Sep. 11, 2009 (FR) ..... 09 04345

(51) Int. Cl.
*H01H 51/22* (2006.01)

(52) U.S. Cl. ..... 335/78; 335/83; 335/86; 200/181

(58) Field of Classification Search ..... 335/4, 78–86; 361/233; 200/181
See application file for complete search history.

(56) References Cited

U.S. PATENT DOCUMENTS

| | | | | |
|---|---|---|---|---|
| 6,078,016 | A * | 6/2000 | Yoshikawa et al. | 200/181 |
| 6,115,231 | A * | 9/2000 | Shirakawa | 361/233 |
| 6,384,952 | B1 * | 5/2002 | Clark et al. | 359/224.1 |
| 6,506,989 | B2 * | 1/2003 | Wang | 200/181 |
| 6,613,993 | B1 * | 9/2003 | Strumpler | 200/181 |
| 6,798,315 | B2 * | 9/2004 | Schaefer | 333/105 |
| 7,071,431 | B2 | 7/2006 | Ruan et al. | |
| 7,498,715 | B2 * | 3/2009 | Yang | 310/309 |
| 2002/0145493 | A1 | 10/2002 | Wang | |
| 2004/0220650 | A1 | 11/2004 | Houben et al. | |
| 2005/0173233 | A1 * | 8/2005 | Kaelberer | 200/181 |

FOREIGN PATENT DOCUMENTS

FR 2 927 466 A1 8/2009

* cited by examiner

*Primary Examiner* — Mohamad Musleh
(74) *Attorney, Agent, or Firm* — Baker & Hostetler LLP

(57) ABSTRACT

A micromachined electromechanical (MEMS) actuator including, for example, an electrostatically actuated electrical switch, is provided, including a first set of conducting plates forming part of the movable element of the switch, interdigitated with a set of conducting plates forming part of the substrate. The plates are, in principle, vertical relative to the surface of the substrate; they are in partial heightwise overlap and a control voltage applied between the two sets of plates exerts a vertical force acting so as to move the movable element closer to the substrate. The conducting plates of the movable element are connected to one another by conducting end crosspieces connecting the ends of these plates so as to surround, laterally, the stationary conducting plates. The distance separating one stationary plate end from the mobile crosspiece is the same at both ends so that the forces exerted in the elongation direction of the plates cancel out. This distance is preferably the same for all the plates.

19 Claims, 4 Drawing Sheets

ELECTROMECHANICAL ACTUATOR WITH INTERDIGITATED ELECTRODES

CROSS-REFERENCE TO RELATED APPLICATION

This application claims priority to foreign French patent application No. FR 09 04345. filed on Sep. 11, 2009. the disclosure of which is incorporated by reference in its entirety.

FIELD OF THE INVENTION

The invention relates to MEMS (micro-electromechanical systems) actuators produced using micromachining technologies inspired by the fabrication of integrated electronic circuit chips.

BACKGROUND OF THE INVENTION

Actuators are elements that cause a mechanical action when a control voltage or a control current is applied. The mechanical action is a movement of a movable element of the actuator. The result of this movement depends on the actuator concerned. In the following, mainly electrical switches are considered, that is to say that the movement of the movable element opens or closes an electrical contact. However, the invention may optionally be applied to other types of actuator, such as optical switches in which the movement of the movable element interrupts or modifies the optical path followed by a light beam.

MEMS electrical switches, actuated by an electromagnetic force produced by a small electrical coil integrated into a stationary part of the switch, the coil acting on a magnetic part borne by the movable element of the actuator, have already been proposed. Other actuators, the movable element of which is moved by an electrostatic force produced between two conducting planar electrodes located facing each other, one formed on a substrate of the actuator and the other borne by the movable element of the actuator, have also been proposed. U.S. Pat. No. 7,071,431 describes switches that operate on this principle. The movable element is an embedded cantilever beam parallel to the stationary substrate. The electrostatic force is applied between the substrate and the beam and acts to attract the free end of the latter toward the substrate. An electrical contact pad is borne on the end of the beam and comes into contact with one or more corresponding pads on the substrate when a sufficient control voltage is applied between the substrate and the beam.

Among others, important factors to take into consideration when designing an electrical switch are:

- the actuating force required to switch the switch from a first state to another state: this force must be sufficient to move the movable element from a first position to a second position (and vice versa) despite any maintaining forces (for example magnetic forces) or restoring forces (for example the elasticity of the beam) that may act on the movable element when it is in the first position;
- the voltage applied to obtain this force: it is desirable for this voltage to be as low as possible, notably so as to be compatible with the supply voltages conventionally used by integrated circuits (i.e. a few volts);
- the current consumption, unavoidable if this switching from one state to another is to be obtained: a low consumption is desirable;

- the current consumption necessary to maintain the switch in its state: ideally the state is maintained with no current consumption;
- the force applied between the electrical contacts when the switch is closed: if the force is too small, the contact will be poor and the switch will only be able to pass a very small current (or else its lifetime is reduced); and
- the distance between the electrical contacts when the switch is in an open state: it must be sufficient for there to be no risk of parasitic current conduction between the contacts in the open state of the switch, but not so large that the movement of the movable element of the switch is too great.

All these parameters are interdependent. For example, there is a relationship between the actuating force and the applied control voltage and a relationship between the distance between the contacts in the open state and the actuating force necessary to close the switch.

SUMMARY OF THE INVENTION

The invention provides a solution that enables a good compromise between the factors described above to be easily found.

According to the invention, an electrostatically controllable micro-electromechanical actuator is provided that comprises a stationary substrate and a movable element hinged on the substrate so that a part of the movable element can move in a first chosen direction, a set of parallel conducting plates on the movable element, the height of which plates extends in the first direction and which are regularly spaced in a second direction perpendicular to the first, and another set of parallel conducting plates on the stationary substrate, the two sets of plates being symmetrically interdigitated with each other and partially overlapping heightwise so that a voltage applied between the two sets produces an electrostatic force having a component along the height of the plates in the first direction, the plates having opposite ends in a third direction perpendicular to the first two, characterized in that the opposite ends of the plates of one of the sets are electrically and mechanically secured to the two end crosspieces which lie facing the opposite ends of the plates of the other set.

The crosspieces are preferably secured to the plates of the movable element. The first set of mobile conducting plates forms a mobile electrode interdigitated with the second set of plates that forms a stationary electrode. A control voltage is applied between these two electrodes.

In other words, if the plates of the two sets were seen in cross section in a plane perpendicular to the chosen direction of movement each plate of the stationary electrode would be entirely surrounded by a conducting material comprising two plates of the mobile electrode as well as the crosspiece parts that link their two opposite ends. Optionally, the reverse could also be true, namely that each mobile plate could be surrounded by two stationary plates secured to two crosspieces.

The crosspieces are preferably micromachined from the same conducting material as the plates of the first series and form a homogenous block therewith.

The conducting plates are preferably planar and their length in the third direction is preferably greater than their height in the direction of movement. This direction of movement (and therefore the height of the plates) is preferably perpendicular to the surface of the substrate in which the stationary and mobile electrodes are machined. The stationary plates therefore rise vertically from the surface of the substrate.

The hinge of the mobile electrode on the substrate is preferably machined from the same material as the stationary or mobile plates. The hinge may consist of torsion arms enabling the plates to rotate in their own plane, therefore about an axis parallel to the substrate and perpendicular to the plates, or of flexion arms or plates embedded in the substrate and also enabling the mobile electrode to rotate in the plane of the plates.

The two end crosspieces that connect the plates of one set together are preferably located at precisely the same distance from the two opposite ends of a plate of the other set, and this distance is preferably the same for all the plates. The application of a control voltage between the stationary and mobile electrodes creates forces in the desired direction of movement, but also longitudinal forces that act between a crosspiece connecting the plates of the first set and the plate ends of the other set. However, these longitudinal forces counteract each other when the two end pieces are located at the same distance from the opposite ends of the same plate.

With this crosspiece-terminated interdigitated electrode structure, high forces are created in the chosen direction of movement by partially, or preferably, completely cancelling out the forces that could be generated in a direction perpendicular to the chosen direction of movement, which forces could cause the electrodes to deform or even bond to adjacent electrodes.

In addition, the crosspieces stiffen the assembly of parallel plates that they connect, making their deformation more difficult.

In one embodiment, the movable element of the actuator is arranged symmetrically on either side of the hinge, like a see-saw, and it comprises two mobile electrodes that are secured to each other (each consisting of a set of conducting plates). These mobile electrodes operate in phase opposition, that is to say that a control voltage applied to one mobile electrode causes it to move closer to the substrate, thereby causing the other to move further away, and vice versa. Each mobile electrode is associated with a respective stationary electrode with which it is interdigitated.

To form an electrical switch, the movable element may bear one or more electrical contact pads for establishing an electrical connection when the movable element moves into a position corresponding to a closed circuit. For example, the pad borne by the movable element short-circuits two conductors borne by the stationary substrate when the free end of the movable element moves closer to the substrate under the action of the electrostatic force.

The switch thus formed may, notably when it consists of symmetrical actuating means, be associated with magnetic retention means that maintain the state of the switch even after the removal of the toggle control voltage or current. The magnetic retention means comprise, for example, a permanent magnet placed above the movable element and a soft film of magnetic material placed beneath the stationary element. Or, otherwise, the magnetic retention means comprise one or more permanent magnets integrated into the stationary substrate beneath the stationary element and the moveable element.

Preferably, a conducting film is formed on the substrate above the plates that form the mobile electrodes, between the plates that form the stationary electrodes and at the same potential as the latter, creating a supplementary electrostatic force of attraction that attracts the conducting plates of the movable element toward the substrate.

BRIEF DESCRIPTION OF DRAWINGS

Other features and advantages of the invention will become apparent on reading the following detailed description given with reference to the appended drawings in which.

DETAILED DESCRIPTION

Figure 1:
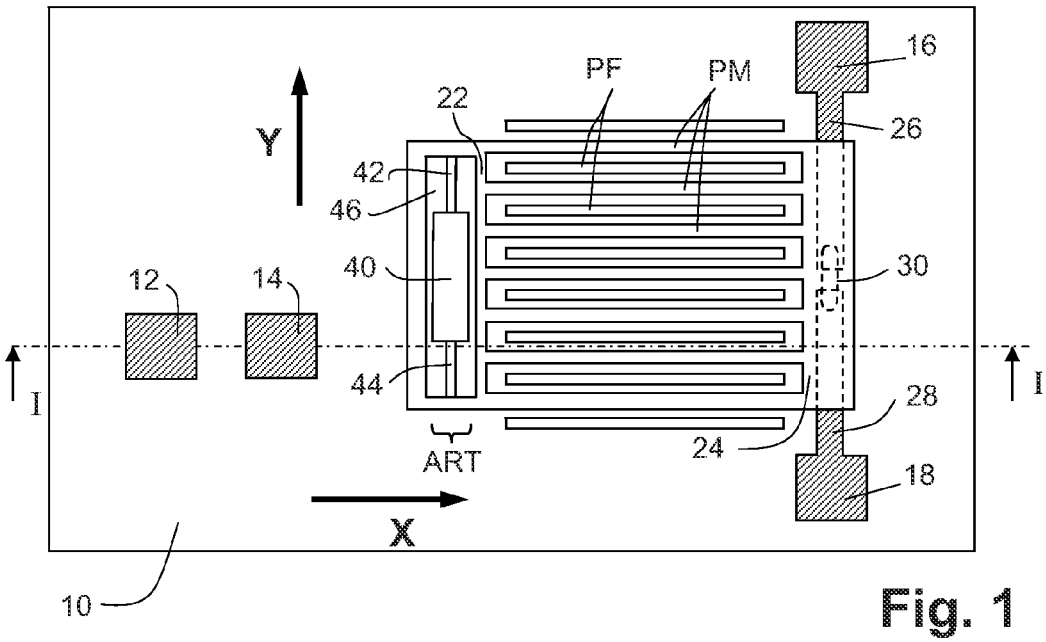
FIG. 1 shows a top view of an actuator according to the invention, micromachined from a planar substrate.
Figure 2:
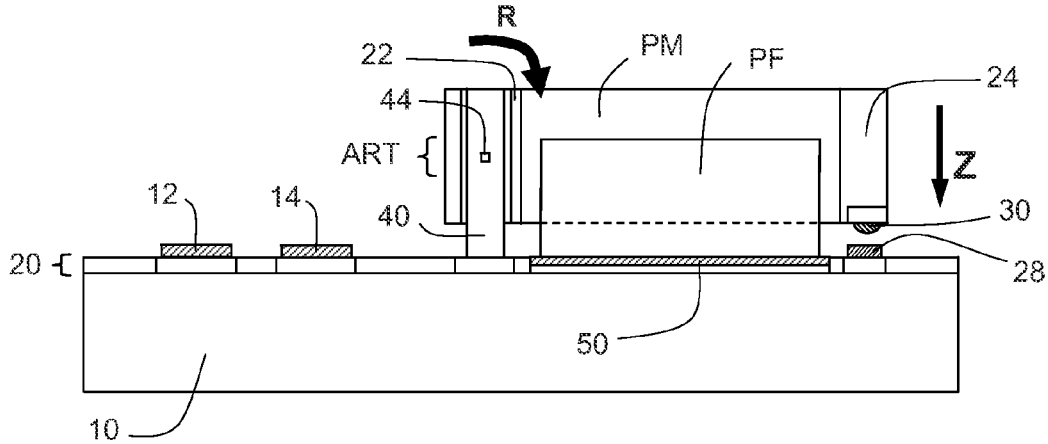
FIG. 2 shows a vertical cross section, along the line I-I of FIG. 1, of the actuator of FIG. 1 in a first state.

The actuator of FIGS. 1 and 2 is an electrical switch which is formed on a planar substrate 10. FIG. 2 shows the switch in the open state. The substrate 10 may be made of an electrical insulator or of silicon, in which there are formed conducting and/or semiconducting and/or insulating films etched into desired patterns with conventional microelectronic techniques (successive film deposition, etching, doping, etc.).

The substrate may bear contact pads 12 and 14 for applying an open or close control voltage to the switch. These pads may have connection wires soldered to them, connecting the switch to external circuit elements that control the switch. The substrate 10 may also bear two pads 16 and 18 that form the output of the switch: when the switch is open, these pads are electrically isolated from each other; when the switch is closed, they are electrically connected to each other. These pads 16 and 18 may also have connection wires soldered to them, connecting the switch to external circuit elements that the switch is intended to control.

The mechanical part of the switch comprises two elements, one stationary relative to the substrate, the other mobile relative to the substrate. These two elements are conductors and serve as stationary electrode and mobile electrode respectively, the actuating force of the switch being an electrostatic force that moves the mobile electrode closer to the stationary electrode when a control voltage is applied between these electrodes. The stationary electrode is connected electrically to the pad 12 and the mobile electrode is connected electrically to the pad 14.

The mobile electrode is connected to the substrate by a hinge ART about which the mobile electrode pivots. To simplify matters, the hinge may be considered to be a simple rotating hinge located at a first end of the mobile electrode. The axis of rotation may be considered as being parallel to the plane of the substrate (the plane of the top view of FIG. 1) and perpendicular to the plane of the cross section of FIG. 2. The direction of rotation is shown by an arrow R and the rotation causes the mobile electrode to tip so that its free end, located at the opposite end to the hinge, moves in a direction perpendicular to the plane of the substrate (the direction is shown by an arrow Z).

The stationary electrode consists of a set of parallel conducting plates PF projecting from the top surface of the substrate by a height in the direction Z. The mobile electrode consists of a set of parallel conducting plates PM symmetrically inserted into the spaces between the plates PF of the stationary electrode. There are therefore two electrodes consisting of a set of interdigitated parallel conducting plates. The electrodes are spaced out in a direction Y parallel to the plane of the substrate.

The parallel plates are elongate in a general elongation direction X that is perpendicular to the directions Y and Z. The plates are preferably planar.

The plates PF and the plates PM partially overlap heightwise, that is to say that the bottom of the mobile plates PM does not reach down to the bottom of the stationary plates PF, and the top of the stationary plates PF does not reach up to the top of the mobile pates PM.

The stationary plates PF are all electrically connected to one another and are electrically connected to the pad 12, they are, in practice, machined in one and the same conducting film. The mobile plates PM are all electrically connected to one another and are electrically connected to the pad 14, they are machined in another conducting film.

The patterns of conducting and insulating films connecting the plates and the pads 12 and 14 are not shown in detail. These films are formed in a near-surface part 20 of the substrate. The mobile plates are electrically connected through the hinge ART. The stationary plates may be electrically connected by direct contact between the bottom of the plates and a conducting film deposited on the substrate.

The mobile electrode comprises not only the mobile conducting plates PM but also crosspieces 22 and 24 located at opposite ends of the plates (i.e. opposite relative to the general elongation direction X). The crosspiece 22 is located near the hinge ART and is mechanically and electrically secured to all the near ends of the mobile plates (i.e. ends near the hinge). The crosspiece 24 is mechanically and electrically secured to all the far ends (those far from the hinge) of the mobile plates. The crosspieces extend over the entire thickness of the mobile plates and are formed in the same films as they are.

Consequently, as the top view of FIG. 1 shows, each of the stationary plates PF, except the two stationary plates at the ends of the set, is entirely surrounded by a rectangle of conducting material, which comprises two mobile plates PM and two crosspiece portions that connect these two mobile plates at each of their opposite ends. FIG. 1 corresponds to the case where there are N+1 stationary plates for N mobile plates. The reverse may also be envisaged, that is to say N+1 mobile plates for N stationary plates, and in this case all the stationary plates are surrounded by two mobile plates and the crosspiece portions that connect them.

Preferably, the distance that separates one end of a stationary plate from the crosspiece 22 is strictly or absolutely equal to the distance which separates the other end of this stationary plate from the crosspiece 24, this distance is preferably constant over the entire height of the stationary plate and identical from one stationary plate to another. This distance (in the X direction) is preferably two to three times greater than the uniform spacing (in the Y direction) between any stationary conducting plate and the adjacent mobile conducting plates.

The rotating hinge ART that allows the group of conducting plates PM that form the mobile electrode to rotate in their own plane about an axis parallel to the substrate comprises, for example, a rigid anchoring foot 40, secured to the substrate, and horizontal torsion bars 42, 44 extending in the Y direction perpendicular to the plane of the parallel plates. These torsion bars 42, 44 connect the anchoring foot 40 and the crosspiece 22. In the example shown, the crosspiece 22 includes a hollow zone 46 in which the anchoring foot and the torsion bars 42 and 44 are located. The torsion bars could also be located outside the mobile electrode, on either side of the latter, rather than in a hollow of the crosspiece 22. The hinge could be produced differently, for example by a thin plate that is able to flex and that extends perpendicularly to the elongation direction of the mobile plates over the entire height of the latter, this plate being anchored at its foot to the substrate along an embedment line in the Y direction. The thinness of the flexion plate enables a flexion, around this embedment line, that is equivalent to a rotation of the set of all the mobile plates in their plane about this line. Here too, the flexion plate may be located in a hollow of the crosspiece 22 or outside the electrode separated into two plates located on either side of the mobile electrode.

The crosspieces 22 and 24 are preferably machined in the same block of conducting material that forms the mobile plates. In one embodiment, this material is a material that is both conductive and magnetic, such as 80/20 nickel-iron.

Applying a control voltage between the stationary conducting plates and the mobile conducting plates exerts an electrostatic force having a component in the Z direction, and this force moves the far end of the mobile electrode closer to the substrate opposing the restoring force created by the torsion arms or the flexion plate of the rotating hinge.

The free far end of the mobile electrode bears one or more contact pads that electrically connect the pads 16 and 18 of the substrate when the applied control voltage has made the mobile electrode move toward the substrate 10.

For example, the pads 16 and 18 are each connected to a respective conductor 26, 28 formed on the substrate. The ends of these conductors 26, 28 are near each other but separated so that there is no direct electrical contact between them, and therefore it is impossible for a current to flow. When the end of the mobile electrode moves closer to the substrate coming into contact at the same time with the two conductor ends 26 and 28, it electrically connects them to each other, short-circuiting the pads 16 and 18.

Preferably, a conductor contact pad 30 is formed beneath the crosspiece 24 to make making this contact easier. The pad is preferably isolated from the conducting plates so that establishing the contact does not place the conductors 26 and 28 at the potential that the control voltage imposes on the mobile electrode.

By way of example, the stationary electrodes are etched in a doped polysilicon film and the mobile electrodes in a nickel-iron film. The thickness of a stationary or mobile plate is approximately 5 microns, the gap between a stationary plate and a mobile plate is from 1 micron to 2 microns, identical on each side of the stationary plate and identical for all the stationary plates. There are between 20 and 50 stationary plates and, if there are N stationary plates, there are N+1 or N−1 mobile plates interdigitated with the stationary plates. The length of the plates may be, typically, from 300 microns to 700 microns and the amplitude of movement of the free end of the mobile electrode may be from 1 micron to 5 microns. The spacing between the end of a stationary plate and the crosspiece 22 or 24 may be preferably from 2 to 5 microns. The height of the plates may be from 5 to 20 microns. The DC control voltage is between 1 volt and 10 volts. The contact force obtained may be of the order of $10^{-4}$ newtons. The contact force does not depend on the height of the plates nor on the height of their mutual overlap; however, it does depend (quadratically) on the voltage applied, on the length of the plates and on their number, and on the gap between stationary and mobile plates; it also depends on the vertical distance between the mobile plates and the conducting film optionally present between the stationary plates.

The switch is open in its rest position in the absence of the control voltage. The switch is maintained in its closed position by maintaining the control voltage, without current consumption. Removing the control voltage returns the switch to the open position, the restoring force of the flexion plate or the torsion bars returning the mobile electrode to its rest position, isolated from the substrate.

Preferably, to increase the force of attraction between the stationary plates and the mobile plates in the vertical direction, the stationary plates rest on a continuous conducting film 50 which is at the same potential as the stationary plates. This film is present in the gaps between the stationary plates and, consequently, tends to uniformly attract downward all the plates PM that form the mobile electrode, these plates being located just above this film.

In the above, the mobile electrode electrically connected two conductors 26 and 28 formed on the substrate when the end of the electrode touched the substrate. It might also be possible to envisage that the contact is made between a pad 30 of the mobile electrode and a single contact 28 of the substrate, establishing a connection between the pad 30 and the contact 28, provided that the current path thus established is isolated from the application path of the control voltage. The current path of the established connection then also passes via the anchoring foot and the torsion bars or flexion plates but remains separate from the current path of the control voltage.

Figure 5:
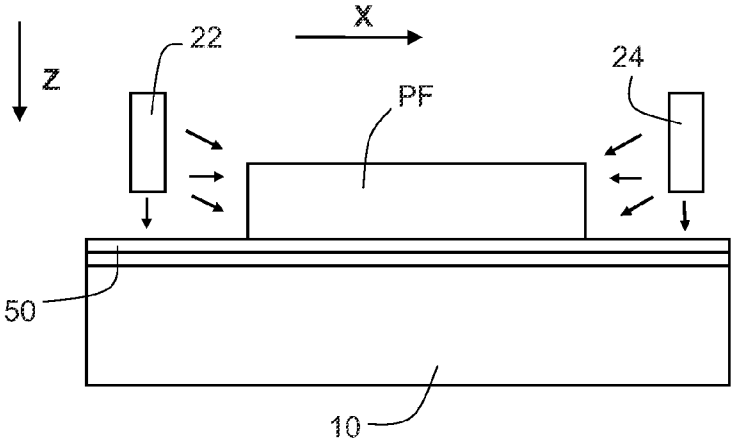
FIG. 4 and FIG. 5 show schematically the various forces that act between the stationary elements and the movable elements of the actuator.
Figure 4:
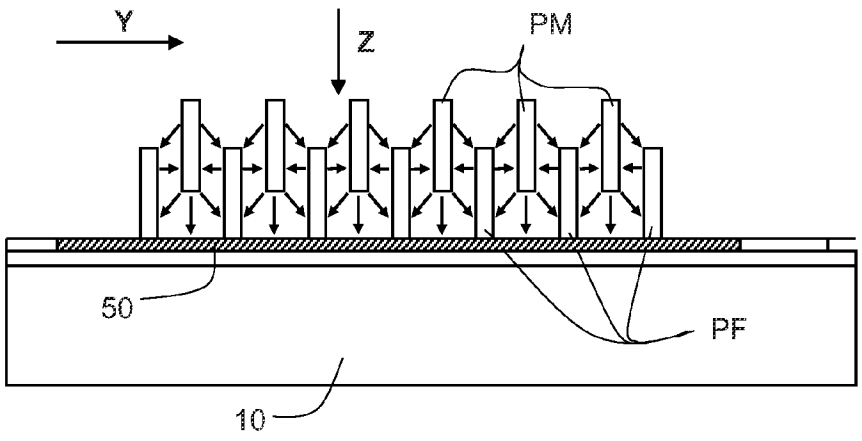

FIG. 4 and FIG. 5 show, schematically, in detail, the forces which act between the stationary conducting plates PF and the mobile conducting plates PM (in the case where there are N+1 stationary plates for N mobile plates, this configuration being preferable as it makes the forces acting on the mobile plates symmetric). The arrows show these forces, the convention being that the direction of the arrow shows the direction of the force of attraction exerted on a mobile plate by a stationary element.

FIG. 4 shows, in the form of a simplified schematic, a transverse cross section of the conducting plates perpendicular to the cross section of FIG. 2. The horizontal forces that act between the mutually overlapping parts of the plates completely cancel one another out. The forces acting between the parts which do not overlap are symmetric but the resultant force is directed downward. Finally, a vertical force acts between the bottom of the mobile plates and the conductor 50 that is located between the stationary plates and that is at the same potential as the latter. The latter force is greater when the switch is in the closed state since the mobile plates are closer to the substrate. It therefore contributes to maintaining the switch in its closed position. However, the force instantaneously disappears when the control voltage is removed, and it therefore does not oppose the return of the switch to its open position under the action of the elastic restoring forces.

FIG. 5 shows a simplified vertical cross section (parallel to the plane of the plates) in which a conducting stationary plate PF and the end crosspieces 22 and 24 that connect the mobile plates are shown. The mobile plates are not shown. Apart from the vertical force that acts between the crosspieces and the conducting film 50 and the vertical force components that act between a crosspiece and an end of the stationary plate, there are horizontal force components. However, these horizontal components are counterbalanced by horizontal forces between the other end of the plate and the other crosspiece. The plates are therefore clearly maintained in their plane and the overall resultant force remains indeed vertical.

One advantage of the interdigitated electrode structure with partial heightwise overlap of the stationary and mobile plates is that the vertical actuating force created between the mobile and stationary plates is high and does not depend on the inclination of the mobile electrode as long as the bottom of the mobile conducting plates remains between the stationary plates and the top of the stationary plates remains between the mobile plates.

Figure 3:
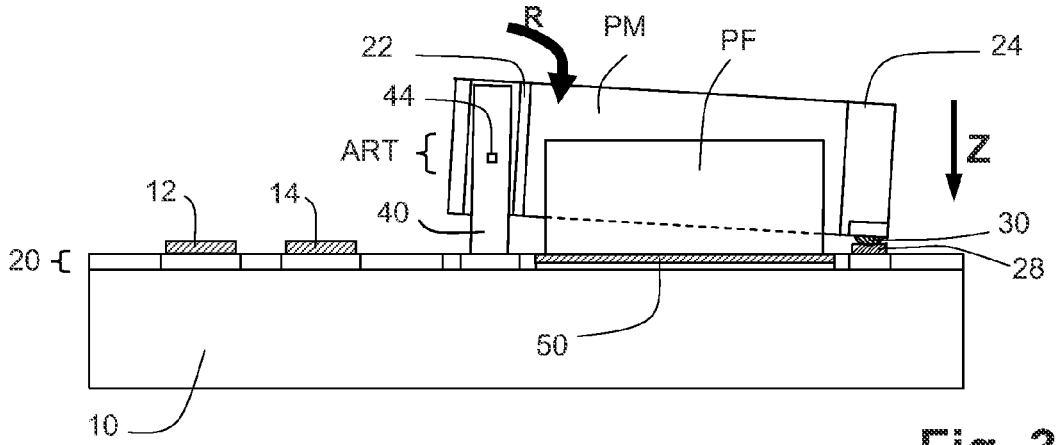
FIG. 3 shows a cross section of the actuator in a second state.

The actuator shown in FIGS. 1 to 3 is not symmetrically controlled in the sense that the toggle from a neutral restore position to an active position is obtained by the application of a control voltage and return to the control position is obtained by virtue of the elastic restoring forces of the hinge once the control voltage is removed.

Figure 6:
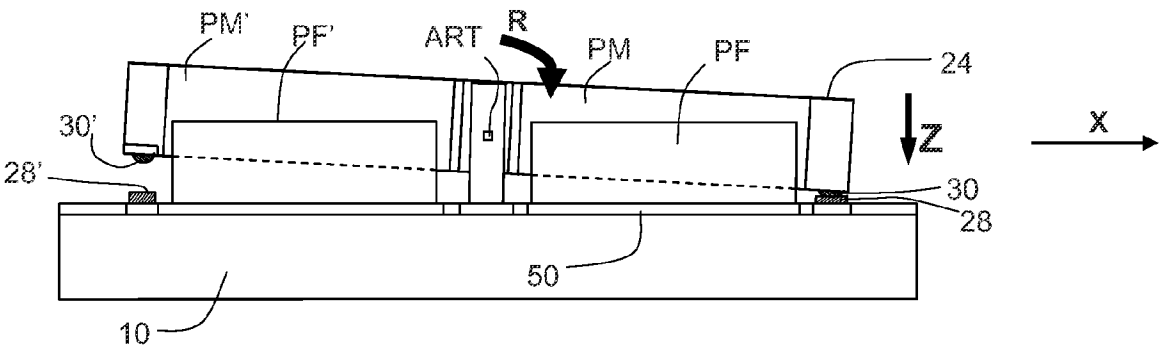
FIG. 6 shows an embodiment of a symmetrically controlled switch with symmetrical contacts.

A symmetrically controlled actuator may also be produced having a first control voltage for making the actuator pass into a first state and a second control voltage for making the actuator pass into another state. This configuration may be obtained by providing two pairs of stationary (conducting plates PF and PF') and mobile (conducting plates PM and PM') electrodes. FIG. 6 shows such a configuration. The two mobile electrodes are identical and hinged on either side of one and the same hinge ART. The two mobile electrodes are secured to each other so that the downward movement of one causes upward movement of the other. A first control voltage is applied between the stationary electrode and the mobile electrode of a pair located on one side of the hinge moving the far end of this mobile electrode closer to the substrate and moving the far end of the other electrode further from the substrate. A second control voltage may be applied between the mobile electrode and the stationary electrode of the second pair, moving the far end of the second mobile electrode closer to the substrate and moving the first mobile electrode further from the substrate.

Thus a symmetrical control is obtained. It may be used to produce a symmetric double switch having one contact open when the other is closed and vice versa. FIG. 6 shows such a symmetrically controlled switch structure with symmetrical double contacts. Contacts 28', 30', corresponding to references 28 and 30 of the first mobile electrode, are provided at the end of the second mobile electrode. The symmetrical control voltages are supplied, for example, to the two stationary electrodes by a pad 12 and to the two mobile electrodes by two other pads such as the pad 14 of FIG. 1. Only one of these two pads receives a control voltage at a given moment. The control pads are not shown in FIG. 6.

In one particular embodiment, the symmetrically controlled actuator, comprising two stationary electrodes and two mobile electrodes secured to one another, may be magnetically retained. The magnetic retention may be obtained by making the material, or a part of the material, of the mobile electrode magnetic, with a magnet located above or beneath the substrate maintaining the mobile electrode group on the side to which it has been toggled. The magnet produces a vertical magnetic field and the direction of the magnetization of the magnetic film of the movable element depends on the inclination (therefore, on the toggle direction) of the movable element. The magnetic field keeps the switch steady in its toggle position. The control voltage may be removed post-toggle without causing the mobile electrodes to return to their rest position, provided, of course, that the magnetic force maintaining the mobile electrode in its direction of inclination is greater than the elastic restoring force of the hinge. With magnetic retention, the electrical energy consumption in a stable state is strictly zero. The electrical contact force established by the switch depends on the magnetic force. It is of course necessary to find a compromise between the magnetic force in the position to be maintained and the electrostatic force required to exit a steady switch position.

In such an embodiment, the conducting material forming the conducting plates of the two mobile electrodes may be produced from a magnetic material such as nickel-iron which is both electrically conductive and magnetic. Coating the mobile conducting electrodes with a magnetic film may also be sufficient. In addition, for the magnetic retention to be more effective, it is desirable to provide a film of magnetic material (called a "soft" film, preferably made of FeNi) on the other side of the mobile electrode. This film may be deposited on the substrate 10 before the formation of the stationary and mobile electrodes. The magnet creates a magnetic field which preferably attracts the mobile electrode in the direction of the closed side, which enables the magnetic retention.

Figure 7:
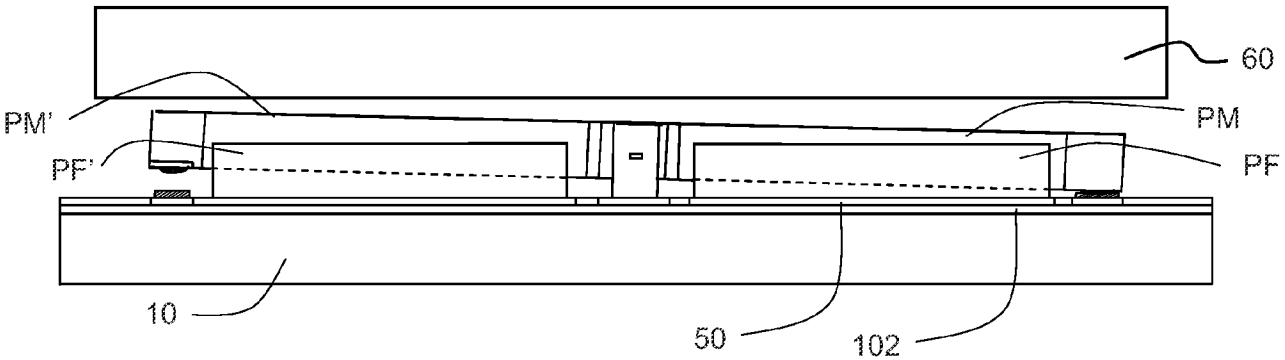
FIG. 7 shows a switch magnetically retained by a magnet placed above the micromachined structure.

FIG. 7 shows a structure with a permanent magnet 60 placed above the stationary and mobile electrodes and a soft magnetic film 102 made of nickel-iron deposited on the substrate 10 above these electrodes.

Instead of a magnet placed above or below the structure with a soft magnetic film reinforcing its action, magnets may be integrated directly into the substrate. It is known to deposit magnets as thin films on the surface of a substrate or in wells etched in the surface of the substrate. These magnets are given a vertical magnetization direction. For example, it is possible to provide a magnet at each end of the mobile electrode, or a single magnet beneath the mobile electrode assembly. The magnets may be made of NdFeB (neodymium-iron-boron) or of samarium-cobalt compounds, and magnetic inductions from about a tenth of a tesla to one tesla may be expected. The deposition may be by electrochemical deposition or sputtering. Deposition of magnetic films 10 to 50 microns thick are technically possible and ensure sufficient magnetic retention. It is necessary to anneal these films at temperatures of approximately 700° C. and they are therefore produced before the multifilm stacks that make up the stationary and mobile electrodes are formed.

Figure 8:
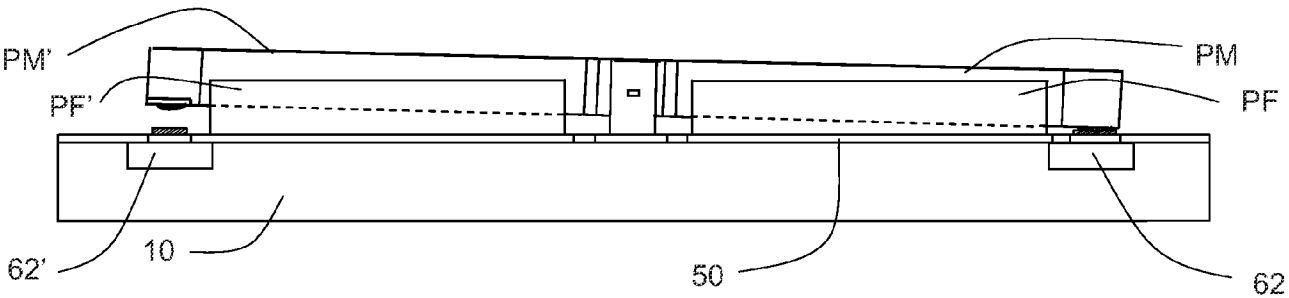
FIG. 8 shows a switch magnetically retained by magnets integrated into the substrate of the mircomachined structure.

FIG. 8 shows a structure with integrated magnets, with two magnets 62 and 62' incorporated into the substrate and placed, respectively, directly beneath the ends of the two mobile electrodes.

The advantage of integrated magnets is that they take up less space, because the magnet 60 and the means of attachment of this magnet to the substrate may be eliminated. In addition, there is no longer a need to provide a step for forming a soft magnetic film (102, FIG. 7) on the substrate. Finally, the radiofrequency behavior (for radiofrequency applications) is better.

All these single or double actuating structures, singly or symmetrically controlled, may be used not only as electrical switches but also in other applications where a small movement (few microns) of the mobile part is useful, notably in optical switches. In this case, the mobile electrode may bear a deflection mirror, placed in the path of a light beam, which modifies or interrupts the optical path of this light beam depending on the toggle state of the mobile electrode and therefore on the angle the surface of the mirror makes with the plane of the substrate.

To produce the interdigitated conducting plates according to the invention, the following procedure may for example be followed in the case of a magnetically retained actuator.

Figure 9:
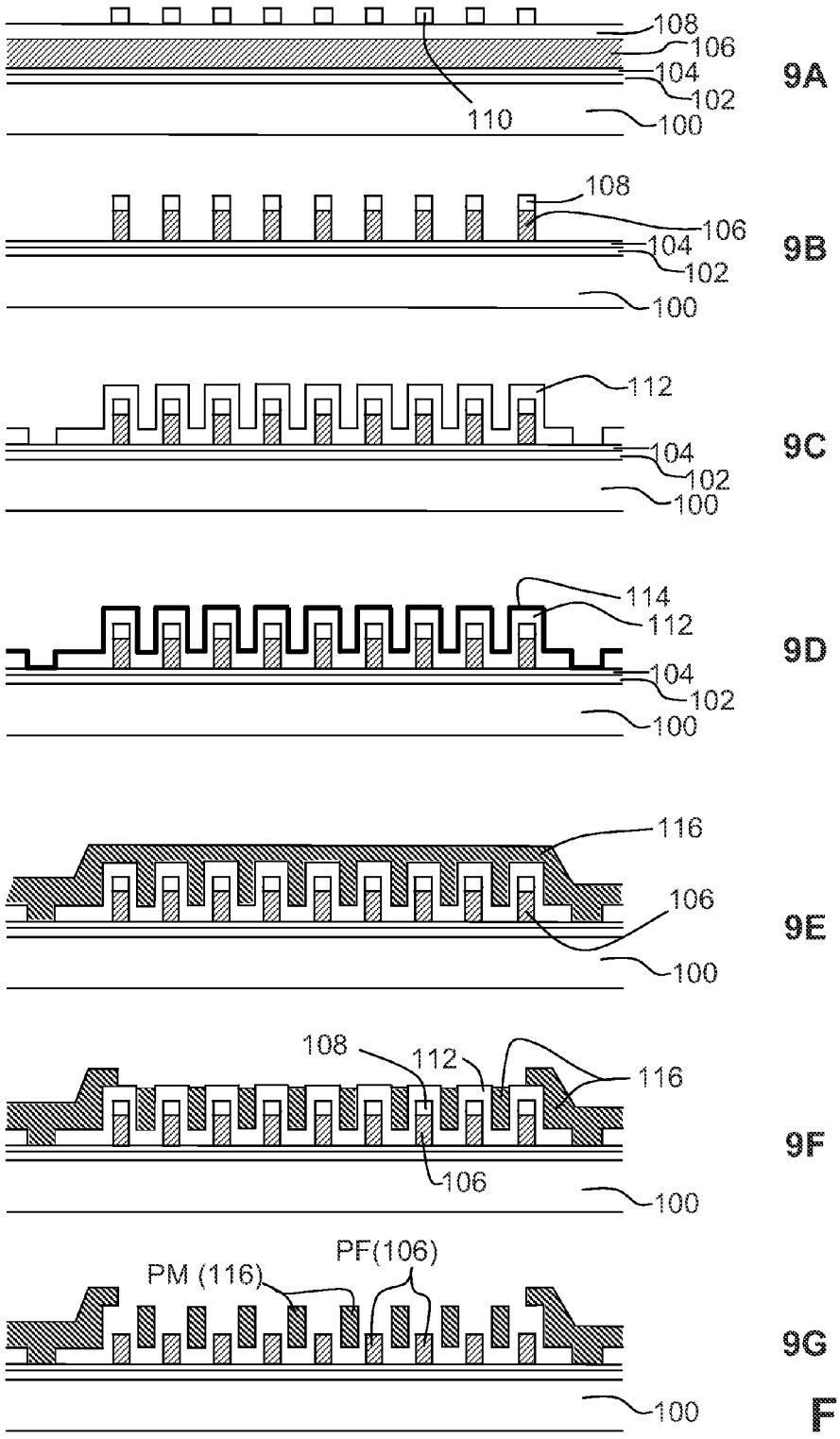
FIGS. 9A-G shows process steps for fabricating the actuator.

A thin magnetic film 102 of nickel-iron is deposited on a semiconducting silicon substrate 100 (FIG. 9), which film will serve to distribute the magnetic field of the magnet that will subsequently be placed above or beneath the substrate.

Next, insulating and conducting films 104 are deposited and etched, establishing an interconnect pattern between the stationary plates and a control pad, and the conducting film optionally present between the stationary plates is also deposited and etched. These films are not shown in detail. Next, a polysilicon film 106, used for fabricating the stationary plates, is deposited. The whole is covered with a silicon oxide film 108 and with a resist film 110 that is photoetched to define the stationary conducting plate pattern. FIG. 9A.

Next, the parallel conducting stationary plate pattern is etched into the oxide film 108 and into the silicon film 106. FIG. 9B.

An insulating film 112 (made of the same material as the film 108) is deposited, which film will serve as a lateral spacer between the mobile plates and the stationary plates and as a vertical spacer between the mobile plates and the substrate. The profile of this film includes openings between the parallel conducting stationary plates, which openings will receive the mobile conducting plate material. FIG. 9C.

A thin nickel film 114 (0.1 micron) is deposited on the film 112; this nickel film forms a seed film that will subsequently allow the electrochemical growth of nickel-iron. FIG. 9D.

A nickel-iron (80%/20%) film 116 approximately 8 to 10 micron thick is grown electrochemically, filling the openings in the film 112 so as to form the mobile conducting plates between the stationary plates. FIG. 9E.

Locally, the upper part of this film is removed, leaving only the parallel conducting plates and the crosspieces connecting them. The crosspieces are not visible in the figure. The parts that can be used for the hinge of the mobile electrode and, in particular, the anchor of the hinge on the substrate are preserved. FIG. 9F.

Finally, the silicon oxide films 108 and 112 are removed to free the mobile plates PM formed by the film 116. The result is two sets of interdigitated partially overlapping conducting plates, one set of which is secured to the substrate and other set of which is free.

In this case, the simplest hinge consists of a thin vertical flexion plate, formed at the same time as the mobile plates but formed in an opening of the film 112 so as to make contact with the stationary substrate.

When it is desired to form integrated magnets, the soft magnetic film 102 is not formed, but integrated magnets will be formed instead. The integrated magnets are preferably recessed in the substrate so as to be flush with the surface.

In a first technique (electrodeposition), magnet emplacement openings may be etched in the substrate, an electrode may be deposited in these openings, and the substrate may be placed in an electrolytic bath containing metal ions that will form the magnet. Thus, a magnetic CoPt compound may notably be formed, deposited electrochemically on the electrodes placed at the bottom of the openings. Annealing ensures a vertical crystal orientation in the material, which makes the subsequent permanent magnetization in the vertical direction easier.

In a second technique (sputtering), the component metals of the magnet to be produced, notably NdFeB (neodymium, iron, boron), are condensed onto the substrate from a vapor phase. The magnet production process may comprise the following steps: starting with a silicon wafer, a photolithography step is used to define, in the silicon, magnet emplacement openings, without removing the photoresist. Next, a film of $SiO_2$ and a film of tantalum are deposited, and the tantalum beyond the openings is lifted off by removing the photoresist on which the tantalum lies. The tantalum serves as a barrier film at the bottom of the openings. An NdFeB compound, for example $Nd_2Fe_{14}B$, is deposited by argon plasma sputtering. The deposition may be carried out at 400° C. producing an amorphous NdFeB film, and the deposition may be followed by a 750° C. anneal ensuring crystallization of the compound in a vertical direction, appropriate for obtaining the vertical magnetization.

The invention claimed is:

1. An electrostatically controllable micro-electromechanical actuator comprising a stationary substrate and a movable element hinged on the substrate so that a part of the movable element can move in a first chosen direction, a first set of parallel conducting plates on the movable element, the height of which plates extends in the first direction and which plates are regularly spaced in a second direction perpendicular to the first direction, and a second set of parallel conducting plates on the stationary substrate, the two sets of plates being symmetrically interdigitated with each other and partially overlapping heightwise so that a control voltage applied between the two sets produces an electrostatic force having a component along the height of the plates in the first direction, the plates having opposite ends in a third direction perpendicular to the first and second directions, wherein the opposite ends of the plates of one of the sets are electrically and mechanically secured to two end crosspieces which extend in the second direction and which lie facing, in the third direction, the opposite ends of the plates of the other set.

2. The actuator as claimed in claim 1, wherein said one set of plates secured to the crosspieces is the first set belonging to the movable element.

3. The actuator as claimed in claim 1, wherein the plates are planar and elongate in the third direction.

4. The actuator as claimed in claim 1, wherein the direction of movement is perpendicular to the surface of the substrate.

5. The actuator as claimed in claim 1, wherein the two end crosspieces of said one set of plates are located at an equal distance from the two opposite ends of a plate of the other set, and the equal distance is the same for all the plates of the other set.

6. The actuator as claimed in claim 1, wherein the movable element comprises a conducting part that may optionally make contact with at least one conductor borne by the stationary substrate depending on the control voltage applied to the actuator.

7. The actuator as claimed in claim 1, wherein the movable element of the actuator is arranged symmetrically on either side of a hinge of the movable element, like a see-saw, and it comprises two sets of mobile conducting plates each interdigitated with a respective set of stationary conducting plates and means for applying a control voltage either between a first set of mobile conducting plates and a corresponding first set of stationary conducting plates or between a second set of mobile conducting plates and a corresponding second set of stationary conducting plates.

8. The actuator as claimed in claim 7, further comprising two symmetric electrical contacts opened or closed by applying a control voltage, one being open when the other is closed and vice versa.

9. The actuator as claimed in claim 8, wherein it is provided with magnetic retention means for maintaining the movable element in a stable position, comprising a magnetizable material in the movable element and a permanent magnet associated with the stationary element, the magnet creating in the magnetizable material a magnetic field in one direction or in another, depending on the inclination of the movable element relative to the substrate.

10. The actuator as claimed in claim 7, wherein it is provided with magnetic retention means for maintaining the movable element in a stable position, comprising a magnetizable material in the movable element and a permanent magnet associated with the stationary element, the magnet creating in the magnetizable material a magnetic field in one direction or in another, depending on the inclination of the movable element relative to the substrate.

11. The actuator as claimed in claim 10, wherein the permanent magnet is placed above the movable element and a layer of magnetic material is placed beneath the stationary element.

12. The actuator as claimed in claim 10, wherein the permanent magnet is integrated into the stationary substrate, beneath the stationary element and the movable element.

13. The actuator as claimed in claim 1, further comprising, formed on the substrate between the conducting plates of the second set, a continuous conducting film held at the same voltage as the conducting plates of the second set, creating a supplementary electrostatic force of attraction that attracts the conducting plates of the first set toward the substrate.

14. The actuator as claimed in claim 2, wherein the movable element of the actuator is arranged symmetrically on either side of a hinge of the movable element, like a see-saw, and it comprises two sets of mobile conducting plates each interdigitated with a respective set of stationary conducting plates and means for applying a control voltage either between a first set of mobile conducting plates and a corresponding first set of stationary conducting plates or between a second set of mobile conducting plates and a corresponding second set of stationary conducting plates.

15. The actuator as claimed in claim 14, further comprising two symmetric electrical contacts opened or closed by applying a control voltage, one being open when the other is closed and vice versa.

16. The actuator as claimed in claim 14, wherein it is provided with magnetic retention means for maintaining the movable element in a stable position, comprising a magnetizable material in the movable element and a permanent magnet associated with the stationary element, the magnet creating in the magnetizable material a magnetic field in one direction or in another, depending on the inclination of the movable element relative to the substrate.

17. The actuator as claimed in claim 5, wherein the movable element of the actuator is arranged symmetrically on either side of a hinge of the movable element, like a see-saw, and it comprises two sets of mobile conducting plates each interdigitated with a respective set of stationary conducting plates and means for applying a control voltage either between a first set of mobile conducting plates and a corresponding first set of stationary conducting plates or between a second set of mobile conducting plates and a corresponding second set of stationary conducting plates.

18. The actuator as claimed in claim 17, further comprising two symmetric electrical contacts opened or closed by applying a control voltage, one being open when the other is closed and vice versa.

19. The actuator as claimed in claim 17, wherein it is provided with magnetic retention means for maintaining the movable element in a stable position, comprising a magnetizable material in the movable element and a permanent magnet associated with the stationary element, the magnet creating in the magnetizable material a magnetic field in one direction or in another, depending on the inclination of the movable element relative to the substrate.

* * * * *